US005904875A

United States Patent [19]

Myers

[11] Patent Number: 5,904,875

[45] Date of Patent: May 18, 1999

[54] SLOPED WEDGE FOR USE WITH CONCRETE WALL PANEL PINS

[76] Inventor: Dallas E. Myers, 4301 Fisher Ave., Middletown, Ohio 45067

[21] Appl. No.: 09/008,189

[22] Filed: Jan. 16, 1998

Related U.S. Application Data

[60] Provisional application No. 60/035,666, Jan. 21, 1997.

[51] Int. Cl.[6] ..... E04G 17/00

[52] U.S. Cl. ..... 249/47; 249/196; 411/355

[58] Field of Search ..... 249/44, 46, 47, 249/192, 196; 411/354, 355, 513

[56] References Cited

U.S. PATENT DOCUMENTS

| | | | |
|---|---|---|---|
| 1,293,391 | 2/1919 | Ewing . | |
| 2,190,701 | 2/1940 | Colt . | |
| 2,882,583 | 4/1959 | Arrighini et al. . | |
| 3,067,479 | 12/1962 | Schimmel | 249/192 |
| 3,171,186 | 3/1965 | Bowden | 249/196 |
| 3,211,413 | 10/1965 | Low, III . | |
| 3,235,217 | 2/1966 | Jahn . | |
| 3,447,771 | 6/1969 | Trimmer . | |
| 3,589,666 | 6/1971 | Kirby . | |
| 3,734,451 | 5/1973 | Tierney | 249/192 |
| 3,815,862 | 6/1974 | Williams . | |
| 4,158,452 | 6/1979 | Gates . | |
| 4,417,425 | 11/1983 | Case et al. . | |
| 5,050,365 | 9/1991 | Edgar et al. . | |

*Primary Examiner*—Michael Safavi
*Attorney, Agent, or Firm*—Wood, Herron & Evans, L.L.P.

[57] ABSTRACT

In the poured concrete wall industry, adjacent form panels are commonly coupled together by a slotted pin and wedge combination. Advantageously, the slotted pin and wedge combination includes a sloped wedge so that the narrow end of the wedge is spaced from the wall panels for easy access and disassembly of the pin and wedge when separating the adjacent wall panels after the poured concrete wall has cured. The sloped wedge is formed by a curved inner surface and a curved outer surface extending towards the narrow end of the wedge. With the curved inner and outer surfaces meeting at a rounded blunt end to allow a hammer to strike the wedge free of the slotted pin upon disassembly of the form panels.

12 Claims, 1 Drawing Sheet

SLOPED WEDGE FOR USE WITH CONCRETE WALL PANEL PINS

This is a continuation-in-part of U.S. Provisional Patent Application Ser. No. 60/035,5666 filed Jan. 21, 1997, which is hereby incorporated herein by reference in its entirety.

BACKGROUND OF THE INVENTION

This invention relates to wall forms for poured concrete walls, and more particularly, to connecting hardware for panels coupled together to construct the wall forms.

It is well known in the art to use prefabricated reusable panel units to construct a wall form for a poured concrete wall. The hardware associated with such panels connects the panels to one another to form the wall form.

Typically, each panel has a marginal frame projecting rearwardly from a back face of the panel to include a flange along the spaced side edges of the panel. The flanges are adapted to be positioned in an edge to edge relationship with the flange of an adjacent panel to construct a concrete wall form. Holes in the flanges of the adjacent panels can be aligned to receive therethrough the shank of a pin or a bolt. The bolt or pin may pass through the ends of tie-rods and are held in position commonly by wedges which are driven though a slot in the shank of the bolt or pin. As the wedges are driven in place, the abutting flanges of the adjacent panel units are drawn together. The pins and wedges constitute a simple mechanism for effectively coupling the panels together. Furthermore, the pins and wedges can be removed from the panels during the dismantling of the wall form by knocking out the wedges from the slots and sliding the pins from their holes to release the adjacent panel units.

In the construction of a concrete wall form, a large quantity of hardware is necessary to connect the adjacent panels together and it is customary for the workers performing the construction operation to carry with them a large bucket of the pins and wedges to join the adjacent panels together. During such operations, the disassembly of the wall forms and connected panels can be very time consuming. One procedure required during the disassembly of the wall forms is the removal of the wedges from the pins. Known wedges are quadrangular and tapered with generally straight side edges and a top end which is wider than a bottom end. When secured in place, the bottom, narrow end of the wedge is lodged in abutting relationship or very close to if not in contact with the flange of the panel. Therefore, the worker often finds it difficult to easily access the narrow end of the wedge to dislodge it from the slot in the pin. Further, since the shorter more narrow bottom end of the wedge must be struck for dislodgement, it is even more difficult for the worker to access and disassemble the large number of pin and wedge assemblies in a very tight, confined and inaccessible location.

Furthermore, the wall forms are commonly constructed in excavated areas such as ditches and trenches when preparing the wall form for a poured concrete wall in a residential basement or below ground floor of a commercial building. As such, the work space for constructing the wall form and for the workers to maneuver and manipulate the associated hardware is extremely tight and limited. Therefore, the installation and disassembly of the pins and wedges is even more difficult and the retrieval of any lost hardware is very problematic. The cost of labor and materials, therefore, has increased accordingly.

One prior art solution to some of these problems has been to permanently connect the attachment hardware to the panels. With such devices, each panel includes numerous such mechanisms. Problems frequently arise because the hardware permanently affixed to the panels breaks or requires repair thereby taking that particular panel out of service until it is repaired. Furthermore, due to the addition of the attachment hardware, each panel is significantly heavier placing a much greater burden on the workers for transporting, installing and manipulating the panels when constructing and disassembling the wall form. Moreover, a particular contractor may have an inventory of panels which are not compatible with the panels having permanently affixed hardware thereby requiring the contractor to entirely discard the current supply of the panels and associated hardware in favor of the panels having an attached hardware design. Additionally, the cost for each panel is significantly increased due to the addition of the often complicated and permanently attached hardware.

Therefore, there exists a need in the industry for an attachment mechanism for coupling adjacent panels and constructing a poured concrete wall and disassembly of the wall form which is easily and conveniently accomplished by the workers in the field to avoid the time consuming and difficult task of disassembling the forms without increasing the weight or cost of the required components.

SUMMARY OF THE INVENTION

These and other objectives of the invention have been attained by an improved pin and wedge assembly for coupling adjacent panels together to form a concrete wall form. The wedge according to a presently preferred embodiment of this invention is generally planar, as is well known in the art, and includes a tapered, curved or sloped configuration such that a broad end of the wedge tapers to a more narrow end, preferably a rounded point of the wedge. The wedge, however, has curved side edges and the narrow bottom end is rounded and blunt. The side edges preferably each have a linear section and a curved section so that the blunt end is spaced from the wall panels and wall panel flanges when the wedge is inserted into a slot in the pin.

The special sloped wedge of this invention is new and unique from the stand point that it is shorter than know wedges which eliminates the need for using other specialized wedges in tight places.

The special sloped wedge of this invention also is unique because it pops out of the slot in the pin by tapping the rounded blunt bottom end from a broad range of angles ranging over 90°. The curved side edges of the wedge allow it to rotate out of the slot in the pin and loosen from the pin more easily, conveniently and accessibly than known wedges.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
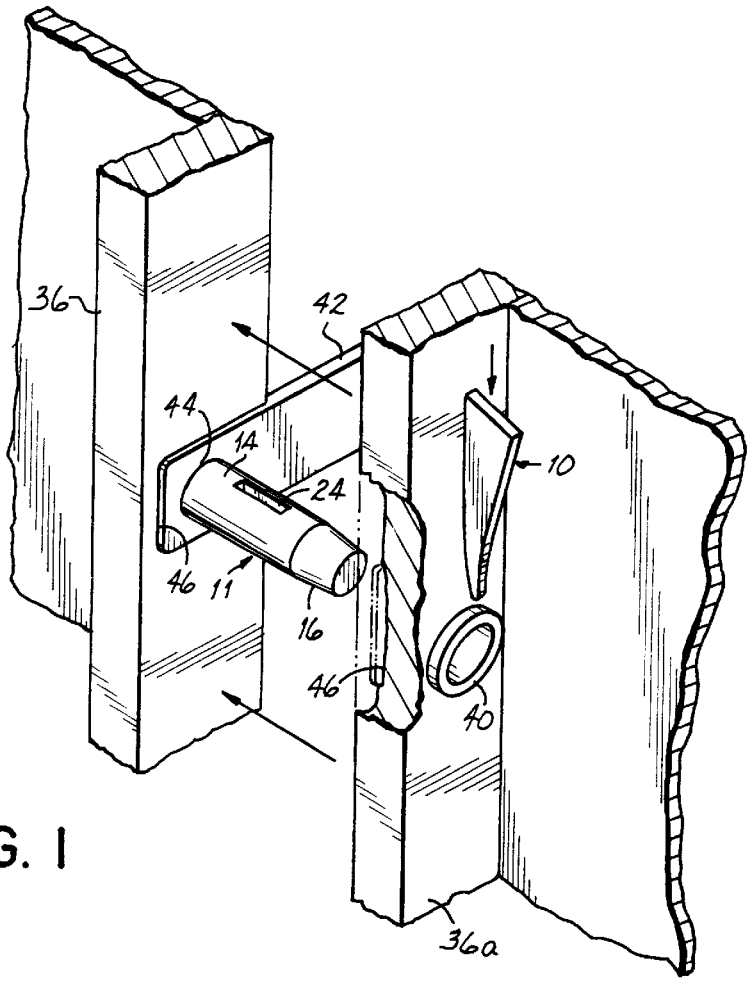
FIG. 1 is a perspective view of a presently preferred embodiment of a sloped wedge according to this invention being inserted into a slot in a pin for joining adjacent wall form panels together.
Figure 2:
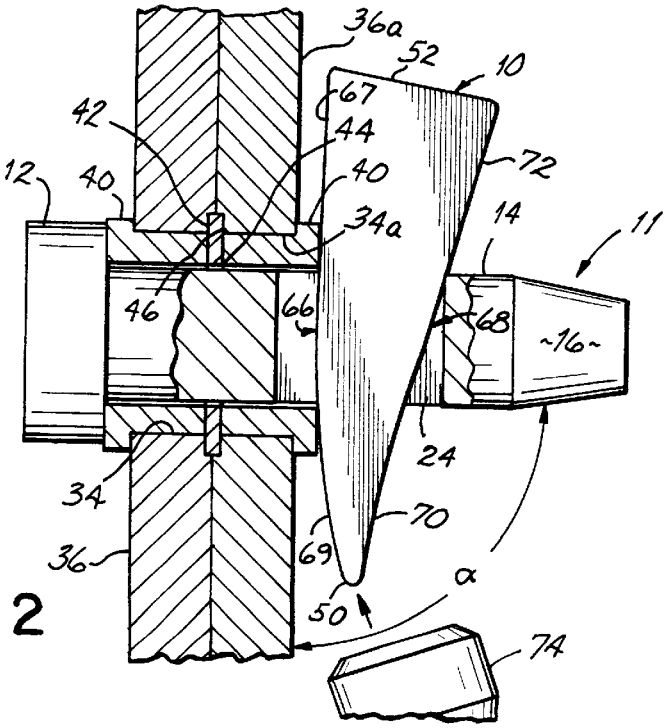
FIG. 2 is a cross-sectional side view of the wedge of FIG. 1 inserted through a slot in a pin projecting through holes in flanges of adjacent panels with a tie-rod held on the shank of the pin which is aligned with the holes in the flanges to be held there in place by the wedge and the wedge being dislodged from the pin as shown.

Referring to FIGS. 1 and 2, a presently preferred embodiment of a wedge 10 according to this invention is shown for use with a pin 11 which includes an enlarged disk shaped head 12 and an elongated generally cylindrical shaped shank 14 extending from the head 12. A tapered end 16 opposite the head 12 terminates in a blunt tip 18. The pin 11 also includes a generally rectangular through slot 24 in the shank 14 proximate the tapered end 16 and extending perpendicularly to a longitudinal axis of the pin 11.

Particular embodiments of the pin and other hardware are shown and described in more detail in U.S. provisional patent application Ser. No. 60/031,382 filed Nov. 20, 1996, which application is hereby expressly incorporated by reference in its entirety.

The shank 14 of the pin 11 is sized for insertion through a hole 34 in a flange 36 of a panel used for constructing a concrete wall form. The hole 34 in the flange 36 is aligned with a similarly configured hole 34*a* in the flange 36*a* of an adjacent panel. The flanges 36, 36*a* may include a bushing 40 seated in the respective holes 34, 34*a* and the diameter of the opening in the bushing 40 is less than the diameter of the disk shaped head 12 on the pin 11 thereby preventing the head 12 from passing through the holes 34, 34*a* in the flanges 36, 36*a*.

As is well known in the art, a tie-rod 42 having hole 44 proximate an end thereof extends between the panels of the concrete wall form to maintain the spacing between opposed panels (not shown) forming a cooperating wail form (not shown). The flanges 36, 36*a* may include a notch or cut-out 46 sized and configured to accommodate the tie-rod 42 seated in the cut-out 46 so that the flanges 36, 36*a* of the adjacent panels can be juxtaposed in face to face abutting relationship.

The curved wedge 10 according to a presently preferred embodiment of this invention comprises a generally planar piece of 11 gauge 1035–1050 hot rolled steel which is heat treated to about 35–40 RC or other appropriate metal which is dimensioned to fit within the slot 24 in the pin 11. The wedge 10 has a sloped, configuration so that a narrow rounded blunt end 50 of the wedge 10 passes into and through the slot 24 and a broad end 52 of the wedge 10 is wider than the slot 24 and is thereby prevented from passing through the slot 24. The entire length of the wedge 10 is considerably shorter than known wedges and measures from the blunt end 50 to the broad end 52 approximately 3.25".

A first or inner edge 66 of the wedge 10 has a generally linear portion 67 and a curved, sloped, arcuate, tapered or otherwise non-linear portion 69, preferably which extends from the blunt end 50 to the linear portion 67. Preferably, the linear portion 67 of the first edge 66 is approximately 2" in length from the broad end 52 of the wedge 10. Furthermore, the linear portion 67 forms approximately a 83° angle with the broad end 52. Preferably, the radius of curvature of the arcuate portion 69 is about 6.0625".

A second or outer edge 68 includes a curved, sloped, arcuate, tapered or otherwise non-linear portion 70, preferably with a radius of about 6.0625", proximate the rounded end 50. The second edge 68 includes a generally linear portion 72 proximate the broad end 52 as shown in FIG. 1. Preferably, the linear portion 72 forms an 83° angle with the broad end 52 and extends approximately 1.4375" from the broad end. The broad end is preferably about 1.094" in length and the radius of curvature of the blunt end 50 and the corners joining the broad end 52 to the respective linear portions 67 and 72 is approximately 0.04'. More preferably, the wedge 10 of this configuration is tumbled to deburr and remove any sharp edges on the wedge 10.

Advantageously, the blunt end 50 of the wedge 10 is more easily inserted into the slot 24 than known wedges because it is more narrow and easier for the worker to quickly position the blunt end 50 into the slot 24 for insertion. Once inserted into the slot 24 as shown in FIG. 2, the linear portion 72 is seated in the slot 24 and the curved portion 70 is exposed thereby positioning the blunt end 50 of the wedge 10 a greater distance from the flange 36 of the wall panel than known wedges having entirely linear side edges. The increased spacing between the rounded blunt end 50 of the wedge 10 from the flange 36 provides greater access for the worker for disassembly of the pin and wedge combination.

Specifically, the increased spacing between the flange 36 and the blunt end 50 enables the worker to use a hammer or other tool 74 to dislodge the wedge 10 from the pin 11. Furthermore, the hammer 74 may impact blunt end 50 at a wide range of angles and still effectively dislodge the wedge 10 from the pin 11. The hammer 74 can strike the blunt end 50 along a path generally parallel to the face of the flange 36 in an upward direction and thereby dislodge the wedge 10. However, due to confined working conditions and other constraints, access for swinging a hammer in an upward direction as is required with known wedges, is frequently unavailable.

The hammer 74 can be directed toward the blunt end 50 or, for that matter, the curved portion 69 at the inner edge 66 of the wedge 10 to release the wedge 10 from the slot 24. The hammer 74 can be directed toward the wedge 10 at any direction within an angle $\alpha$ as shown in FIG. 2 extending between the flange 36 and the sloped edge 16 of the pin 11. Because of the non-linear configuration of the wedge 10, impact by the hammer 74 on the wedge 10 anywhere within the range $\alpha$, which is greater than 90° will dislodge the wedge 10 from the slot 24. Such a blow by the hammer or tool 74 will direct the wedge 10 upwardly and/or rotate the wedge 10 in a clockwise direction and as shown in FIG. 2, out of the slot 24 as the curved portion 70 of the outer edge 68 is forced against the bushing 40 or other portion of the flange 36. Therefore, greater access to the wedge 10 is readily provided to the worker for releasing the wedge 10 from the pin 11 than with known pin 11 and wedge 10 combinations.

From the above disclosure of the general principles of the present invention and the preceding detailed description of a preferred embodiment, these skilled in the art will readily comprehend the various modifications to which this invention is susceptible. Therefore, I desire to be limited only by the scope of the following claims and equivalents thereof.

I claim:

1. A combination for connecting a first panel to a second panel for forming a wall form for a poured concrete wall, wherein the first panel has a first flange extending outwardly therefrom and a first aperture formed therethrough, the second panel has a second flange extending outwardly therefrom and a second aperture formed therethrough which is aligned with the first aperture, the combination comprising:

a pin having an enlarged head and an elongated shank extending from the head and an end opposite the head, a through slot in the shank proximate the end and extending perpendicularly to a longitudinal axis of the pin; and a wedge dimensioned to fit within the slot, the wedge having a rounded narrow end which passes into and through the slot of the pin and a broad end of the wedge which does not pass through the slot, a first edge of the wedge extending between the narrow end and the broadend and having a first non-linear portion;

wherein when the first and second panels are positioned with the first and second apertures aligned the pin is inserted into the apertures and the narrow end of the wedge is inserted into the slot to secure the pin in the apertures and releasably couple the first and second panels together with the narrow end being spaced from the flanges and the panels so that the wedge can be dislodged from the pin by striking wedge proximate the narrow end.

2. The combination of claim 1 wherein the first non-linear portion is arcuate.

3. The combination of claim 1 wherein the first non-linear portion is proximate the narrow end of the wedge.

4. The combination of claim 1 further comprising:

a first generally linear portion on the first side edge proximate the broad end, wherein the first non-linear portion is arcuate and proximate the narrow end which is rounded.

5. The combination of claim 4 further comprising:

a second edge of the wedge extending between the broad and narrow ends, the second edge having a second generally linear portion proximate the broad end and a second non-linear portion which is arcuate and proximate the narrow end.

6. A combination for constructing a poured concrete wall, the combination comprising:

a first panel and a second panel, the first panel having a first flange extending outwardly therefrom and a first aperture formed therethrough, the second panel having a second flange extending outwardly therefrom and a second aperture formed therethrough which is aligned with the first aperture;

a pin having an enlarged head and an elongated shank extending from the head and an end opposite the head, a through slot in the shank proximate the end and extending perpendicularly to a longitudinal axis of the pin; and a wedge dimensioned to fit within the slot, the wedge having a rounded narrow end which passes into and through the slot of the pin and a broad end of the wedge which does not pass through the slot, a first edge of the wedge extending between the narrow end and the broad end and having a first non-linear portion;

wherein when the first and second panels are positioned with the first and second apertures aligned the pin is inserted into the apertures and the narrow end of the wedge is inserted into the slot to secure the pin in the apertures and releasably couple the first and second panels together with the narrow end being spaced from the flanges and the panels so that the poured concrete wall is formed in part by the first and second panels, after which the wedge can be dislodged from the pin by striking wedge proximate the narrow end.

7. A combination for connecting a first panel to a second panel for forming a wall form for a poured concrete wall, wherein the first panel has a first flange extending outwardly therefrom and a first aperture formed therethrough, the second panel has a second flange extending outwardly therefrom and a second aperture formed therethrough which is aligned with the first aperture, the combination comprising:

a pin having an enlarged head and an elongated shank extending from the head and an end opposite the head, a through slot in the shank proximate the end and extending perpendicularly to a longitudinal axis of the pin; and a wedge dimensioned to fit within the slot, the wedge having a narrow rounded end which passes into and through the slot of the pin and a broad end of the wedge which does not pass through the slot, a first edge of the wedge extending between the narrow end and the broad end and having a first arcuate portion proximate the narrow end and a first generally linear portion proximate the broad end, a second edge of the wedge extending between the broad and narrow ends, the second edge having a second generally linear portion proximate the broad end and a second arcuate proximate the narrow end;

wherein when the first and second panels are positioned with the first and second apertures aligned the pin is inserted into the apertures and the narrow end of the wedge is inserted into the slot to secure the pin in the apertures and releasably couple the first and second panels together with the narrow end being spaced from the flanges and the panels so that the wedge can be dislodged from the pin by striking wedge proximate the narrow end.

8. The combination of claim 7 wherein the pin and the wedge are not attached to the first and second panel when not in use.

9. A method of constructing a poured concrete wall with a wall form, the method comprising the steps of:

positioning first and second wall panels adjacent one another, each of the wall panels having a flange extending outwardly therefrom and an aperture formed in the flange;

aligning the apertures in the flanges with each other;

inserting a pin into the apertures, the pin having an enlarged head and an elongated shank extending from the head and an end opposite the head, a through slot in the shank proximate the end and extending perpendicularly to a longitudinal axis of the pin, the head being juxtaposed to one of the flanges and preventing the pin from passing through the flanges;

inserting a rounded narrow end of a wedge into and through the slot to thereby draw the flanges of the panels together and form the wall form, the wedge having a broad end which does not pass through the slot, a first edge of the wedge extending between the narrow end and the broad end and having a first non-linear portion;

pouring a volume of concrete;

retaining the concrete with the wall form;

curing the concrete into the poured concrete wall;

impacting the wedge at a position spaced from the broad end to thereby dislodge the wedge from the pin; and disassembling the wall form.

10. The method of claim 9 wherein the inserting of the narrow end of the wedge results in the narrow end being spaced from the flange of the panel.

11. The method of claim 9 wherein the impacting of the wedge is at the narrow end.

12. The method of claim 9 further comprising:

detaching the pin and the wedge from the first and second wall panels after the impacting of the wedge.

* * * * *

UNITED STATES PATENT AND TRADEMARK OFFICE

CERTIFICATE OF CORRECTION

PATENT NO. : 5,904,875

DATED : May 18, 1999

INVENTOR(S) : Dallas E. Myers

It is certified that error appears in the above-indentified patent and that said Letters Patent is hereby corrected as shown below:

Column 1, Line 2, "60/035,5666" should read --60/035,666--.

Column 4, Line 1, "0.04'" should read --0.04"--.

Column 5, Line 4, "broadend" should read --broad end--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*